US010338508B2

(12) United States Patent
Kubo

(10) Patent No.: US 10,338,508 B2
(45) Date of Patent: Jul. 2, 2019

(54) IMAGE FORMING APPARATUS WITH IMAGE POSITION DEVIATION CORRECTION AND CONTROL METHOD FOR CORRECTING IMAGE POSITION DEVIATION

(71) Applicants: KABUSHIKI KAISHA TOSHIBA, Minato-ku, Tokyo (JP); TOSHIBA TEC KABUSHIKI KAISHA, Shinagawa-ku, Tokyo (JP)

(72) Inventor: Tomoaki Kubo, Mishima Shizuoka (JP)

(73) Assignees: KABUSHIKI KAISHA TOSHIBA, Tokyo (JP); TOSHIBA TEC KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/713,837

(22) Filed: Sep. 25, 2017

(65) Prior Publication Data

US 2019/0094773 A1 Mar. 28, 2019

(51) Int. Cl.

| | |
|---|---|
| ***G03G 15/01*** | (2006.01) |
| ***G03G 15/20*** | (2006.01) |
| ***G03G 15/08*** | (2006.01) |
| ***G03G 15/00*** | (2006.01) |
| *G03G 15/04* | (2006.01) |

(52) U.S. Cl.

CPC ..... *G03G 15/2064* (2013.01); *G03G 15/0848* (2013.01); *G03G 15/5045* (2013.01); *G03G 15/04081* (2013.01); *G03G 15/5008* (2013.01)

(58) Field of Classification Search

CPC ..... G03G 15/5041; G03G 15/5045; G03G 15/5054; G03G 15/5058

USPC ..... 399/44, 49, 301

See application file for complete search history.

(56) References Cited

U.S. PATENT DOCUMENTS 8,717,639 B2 * 5/2014 Arakawa ..... H04N 1/04 399/301

FOREIGN PATENT DOCUMENTS

| | | |
|---|---|---|
| JP | 2009-92688 | 4/2009 |
| JP | 2011-59628 | 3/2011 |
| JP | 2011-110825 | 6/2011 |

* cited by examiner

*Primary Examiner* — William J Royer

(74) *Attorney, Agent, or Firm* — Amin, Turocy & Watson LLP

(57) ABSTRACT

An image forming apparatus includes a developing section, an image carrier, a deviation correction section, a specific pixel detection section and a determination section. The developing section forms a visible image on a photoconductor for each type of developer. The image carrier carries the visible images formed in a plurality of the developing sections. The deviation correction section corrects position deviation of the plurality of visible images formed on the image carrier. The specific pixel detection section detects the specific pixel used to form an image with a plurality types of developers. The determination section determines execution of correction in the deviation correction section according to information indicating an amount of the specific pixels.

20 Claims, 5 Drawing Sheets

IMAGE FORMING APPARATUS WITH IMAGE POSITION DEVIATION CORRECTION AND CONTROL METHOD FOR CORRECTING IMAGE POSITION DEVIATION

FIELD

Embodiments described herein relate generally to an image forming apparatus and a control method.

BACKGROUND

Conventionally, a transfer position deviation occurs in an image forming apparatus in some cases. The transfer position deviation is mainly caused by a change in dimension of an optical unit in response to a change in temperature within the apparatus. Due to the change in the dimension, there is a case in which deviation occurs at a transfer position onto an image carrier relating to a plurality types of toner. Such a phenomenon is referred to as a transfer position deviation. In order to suppress degradation of image quality caused by such a phenomenon, a deviation correction processing is executed. The deviation correction processing refers to correcting relative deviation occurring at the transfer position onto the image carrier relating to a plurality types of the toner.

Much time is required in the execution of such a deviation correction processing. Therefore, if the deviation correction processing occurs for a user who wants to print, there is a possibility of requiring much time until a printing object is acquired.

DETAILED DESCRIPTION

In accordance with an embodiment, an image forming apparatus comprises a developing section, an image carrier, a deviation correction section, a specific pixel detection section and a determination section. The developing section forms a visible image on a photoconductor for each type of developer. The image carrier carries the visible images formed in a plurality of the developing sections. The deviation correction section corrects position deviation of the plurality of visible images formed on the image carrier. The specific pixel detection section detects a specific pixel used to form an image with a plurality types of developers. The determination section determines execution of correction in the deviation correction section according to information indicating an amount of the specific pixels.

Figure 1:
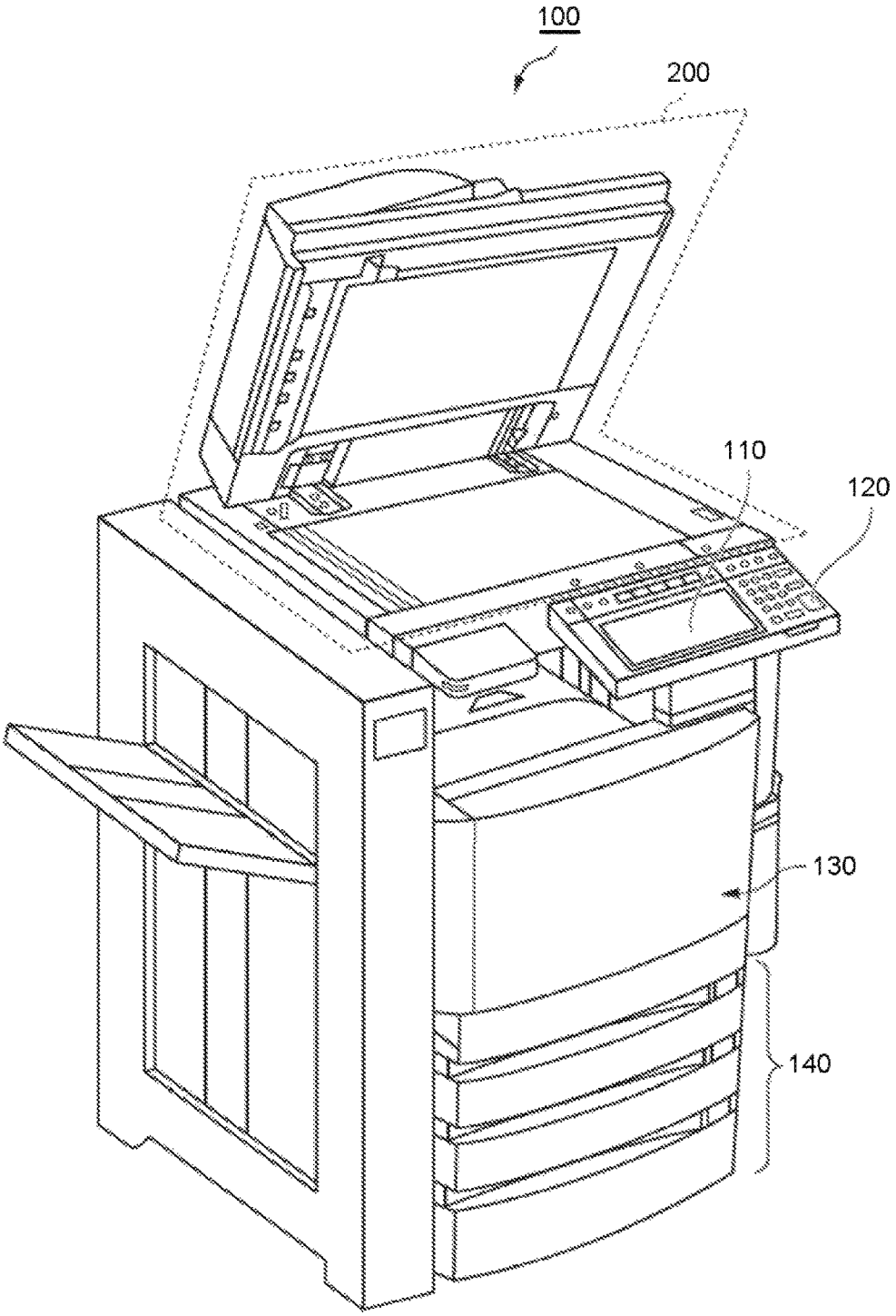
FIG. 1 is an external view illustrating an example of the whole constitution of an image forming apparatus according to an embodiment.
Figure 2:
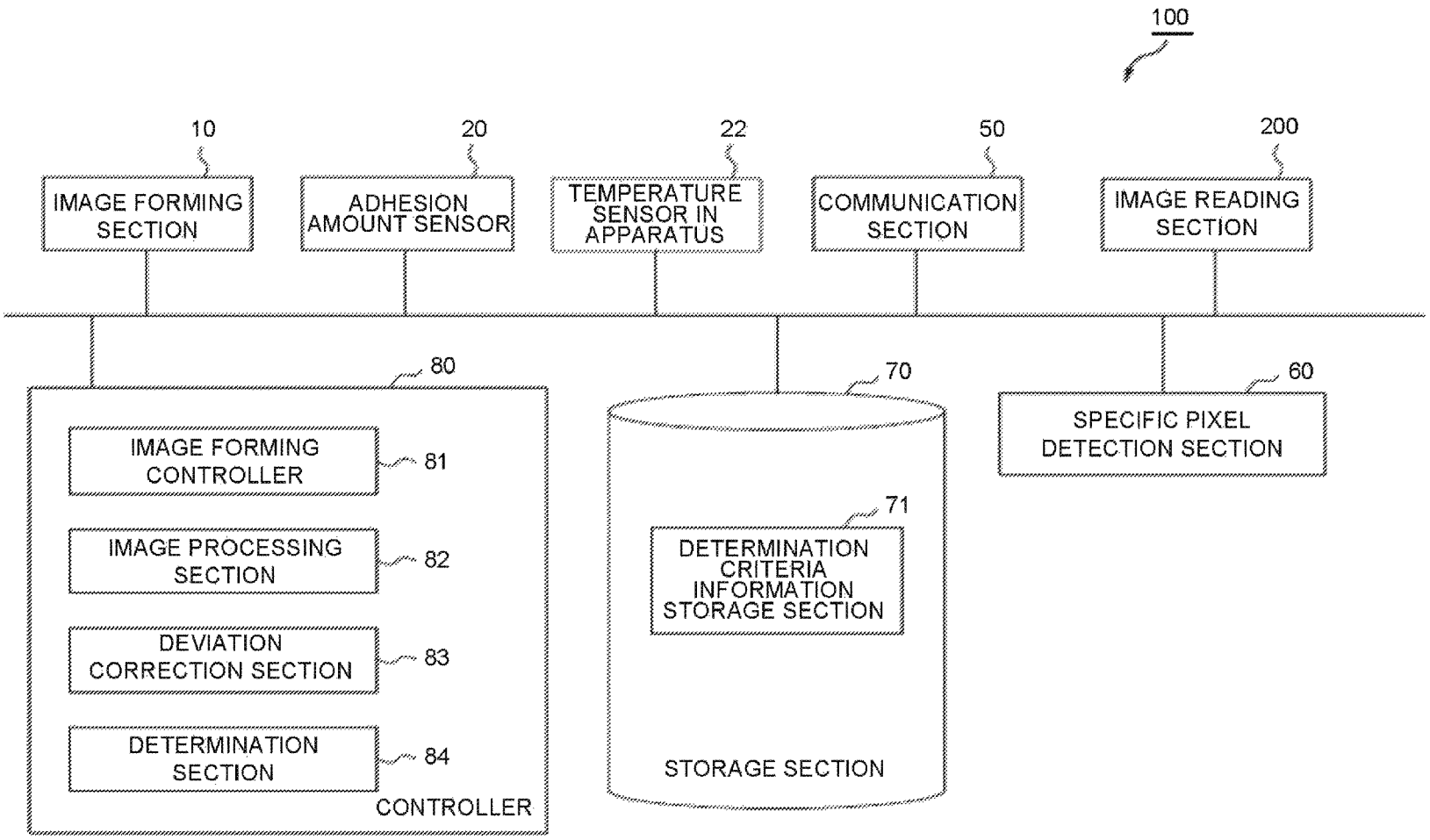
FIG. 2 is a block diagram illustrating functional components relating to a visible image forming processing by the image forming apparatus according to the embodiment.

FIG. 1 is an external view illustrating an example of the whole constitution of an image forming apparatus 100 according to the embodiment. The image forming apparatus 100 is, for example, a multi-functional peripheral. The image forming apparatus 100 is provided with a display 110, a control panel 120, a printer 130, a sheet housing section 140 and an image reading section 200. The image forming apparatus 100 has a controller 80 which controls the entire apparatus as shown in FIG. 2. The image forming apparatus 100 forms an image on a sheet using a developer such as toner. The sheet is, for example, a paper or a label paper. The sheet may be an optional object as long as the image forming apparatus 100 can form an image on a surface thereof.

The display 110 is an image display device such as a liquid crystal display, an organic EL (Electro Luminescence) display and the like. The display 110 displays various information relating to the image forming apparatus 100.

The control panel 120 includes a plurality of buttons. The control panel 120 receives an operation by a user. The control panel 120 outputs a signal in response to an operation executed by the user to the controller 80 of the image forming apparatus 100. Further, the display 110 and the control panel 120 may be constituted as an integrated touch panel.

The printer 130 prints an image on the sheet based on image information generated by the image reading section 200 or image information received via network. The printer 130 includes an image forming section 10, a fixing section 30, a sheet discharge section 40, a conveyance section and the like described later. The printer 130 prints an image with the developer such as the toner. The sheet on which the image is printed may be a sheet housed in the sheet housing section 140, or a sheet that is manually fed.

The sheet housing section 140 houses the sheet used in the image formation by the printer 130.

The image reading section 200 reads the image information which is a reading object as intensity of light. The image reading section 200 records the read image information. The recorded image information may be transmitted to another information processing apparatus via the network. The recorded image information may be used to form an image on the sheet by the printer 130.

FIG. 2 is a block diagram illustrating functional components relating to a visible image forming processing by the image forming apparatus 100 according to the embodiment. The visible image forming processing is used for forming a visible image by transferring the visible image onto the sheet. The image forming apparatus 100 includes an image forming section 10, an adhesion amount sensor 20, a communication section 50, a specific pixel detection section 60, a storage section 70, the controller 80 and the image reading section 200.

The image forming section 10 operates under the control of an image forming controller 81. The image forming section 10 has an exposure section, a developing section, a primary transfer section, and a secondary transfer section which are described later. For example, the image forming section 10 operates as follows. The exposure section of the image forming section 10 forms an electrostatic latent image on a photoconductive drum based on image information which is an object of image formation. The developing section of the image forming section 10 forms a visible image by attaching a developer to the electrostatic latent image. The primary transfer section of the image forming section 10 transfers the formed visible image onto an image carrier. The secondary transfer section of the image forming section 10 transfers the visible image formed on the image carrier onto the sheet.

The adhesion amount sensor 20 detects the adhesion amount of the developer to the visible image formed on the image carrier of the image forming section 10. The adhesion amount sensor 20 may be, for example, an optical sensor. Based on the detection result of the adhesion amount sensor 20, a deviation correction processing is executed.

The communication section 50 is a network interface device. The communication section 50 communicates data with other devices via a network. The communication section 50 may receive image information which is a printing object from another information processing apparatus, for example. In this case, the image information received by the communication section 50 is processed by the controller 80 as well as information indicating a received instruction of the printing.

The specific pixel detection section 60 is constituted by using a processor. The specific pixel detection section 60 may be realized by executing a program of the specific pixel detection processing by a general-purpose processor (for example, Central Processing Unit). The specific pixel detection section 60 may be constituted by using hardware for specific application such as an ASIC (Application Specific Integrated Circuit). The specific pixel detection section 60 detects a specific pixel contained in an image (hereinafter referred to as the "processing target image") to be formed by the image forming section 10. The specific pixel has pixel information to be formed by using plural types of toner. For example, the specific pixel may have a color to be formed using toner having plural kinds of colors (for example, cyan, magenta, yellow, and black).

The storage section 70 is a storage device such as a magnetic hard disk device or a semiconductor storage device. The storage section 70 functions as a determination criteria information storage section 71. The determination criteria information storage section 71 stores determination criteria information. The determination criteria information indicates determination criteria at the time a determination section 84 executes a determination processing based on a detection result in the specific pixel detection section 60. For example, the determination criteria information may indicate a threshold value showing a boundary of determination between a case in which the deviation correction processing is executed and a case in which it is not executed. In this case, the threshold value is a specific amount indicated by the detection result. For example, the determination criteria information may be information in which an amount of the specific pixels indicated by the detection result and information indicating whether to execute the deviation correction processing are associated with each other.

The controller 80 is a processor. The controller 80 functions as the image forming controller 81, an image processing section 82, a deviation correction section 83 and the determination section 84 through executing a program by a processor. The image forming controller 81 forms a toner image corresponding to the processing target image on the sheet by controlling the image forming section 10.

The image processing section 82 executes an image processing on the processing target image. The image processing executed by the image processing section 82 may be predetermined in the image forming apparatus 100. The image processing executed by the image processing section 82 may be determined according to an instruction from the user.

The deviation correction section 83 executes the deviation correction processing. The deviation correction processing corrects a relative deviation occurring at a transfer position onto the image carrier with respect to a plurality of types of toner. For example, it is assumed that a blue pixel is arranged with respect to a position indicated by a pixel value (x1, y1) with a certain coordinate. The cyan toner and the magenta toner are superimposed and transferred at the position indicated by the coordinate. At this time, if the relative deviation occurs at the transfer positions of the cyan toner and the magenta toner, there is a possibility that the single cyan color part or a single magenta color part is generated in addition to blue. A processing of correcting the relative position deviation of a plurality of types of toner is the deviation correction processing. The deviation correction section 83 records the temperature in apparatus at that time point in the storage section 70 if the deviation correction processing is executed.

The determination section 84 determines whether or not the deviation correction processing is executed based on a first condition based on an operating environment of the image forming apparatus and a second condition based on the detection result of the specific pixel. The first condition may be that a temperature change amount of the temperature in the image forming apparatus (hereinafter referred to as "temperature in apparatus") is equal to or greater than a threshold value. The temperature change amount indicates a difference between the temperature in apparatus which is a measurement result of a temperature sensor in apparatus 22 at the time of forming the processing target image and the temperature in apparatus in the execution of the deviation correction processing last time. Regardless of the temperature, the first condition may be a condition relating to humidity, the number of times of image formation, the number of times of consecutive image formation, or elapse of a predetermined time. The first condition may be any condition as long as it correlates with the occurrence of the transfer position deviation.

The second condition is that the amount of the specific pixels indicated by the detection result of the specific pixel detection section 60 is greater than or equal to a threshold value. The determination section 84 determines execution of the deviation correction processing if the first condition and the second condition are satisfied. The deviation correction section 83 executes the deviation correction processing if the determination section 84 determines the execution of the deviation correction processing.

Figure 3:
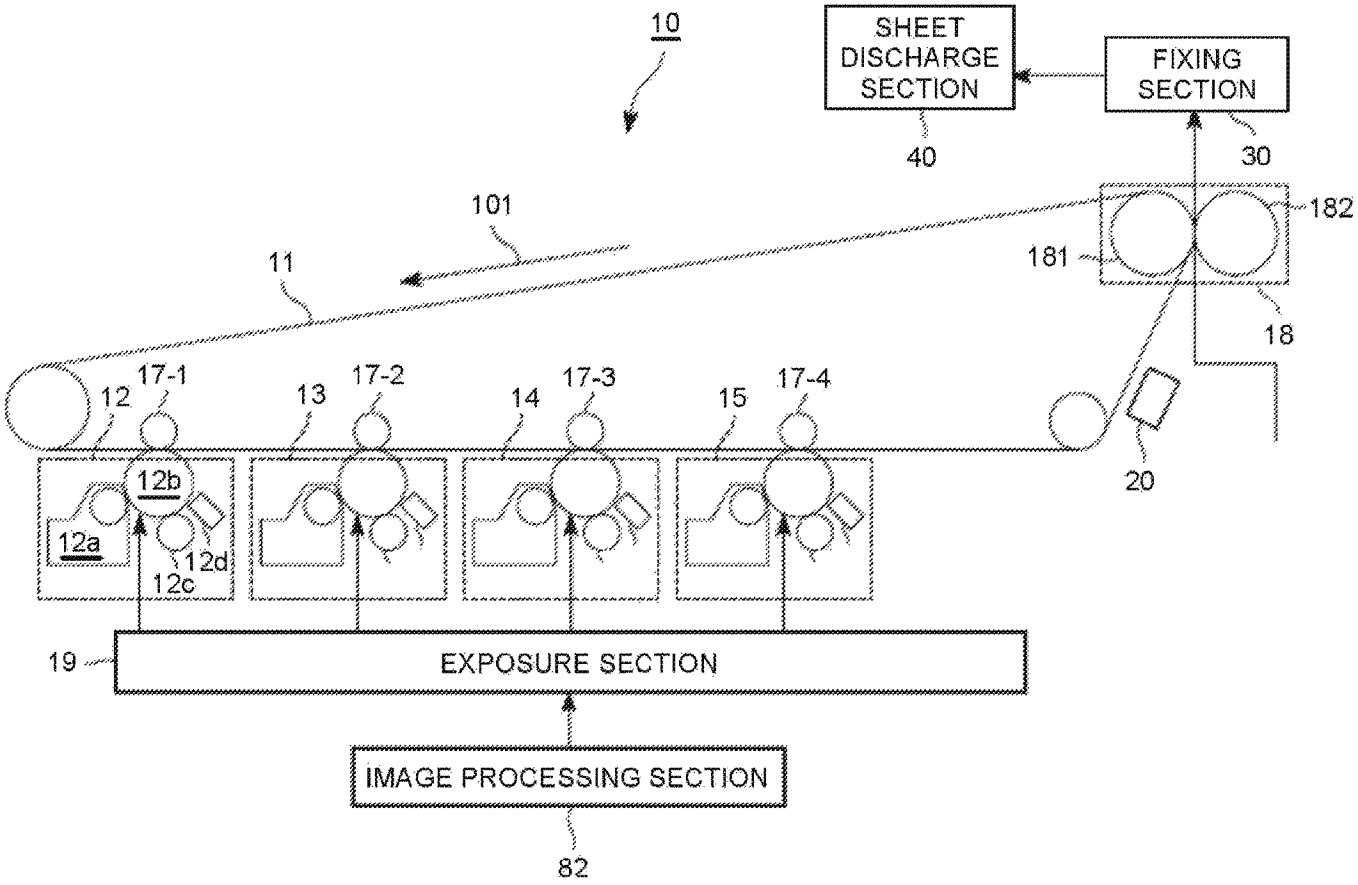
FIG. 3 is a diagram illustrating an example of the internal constitution of an image forming apparatus 100.

FIG. 3 is a diagram illustrating an example of the internal constitution of the image forming apparatus 100. In the example of FIG. 3, the image forming apparatus 100 is a 4-tandem type image forming apparatus. However, the image forming apparatus 100 need not be limited to the 4-tandem type.

The image forming apparatus 100 includes the image forming section 10, the adhesion amount sensor 20, the fixing section 30 and the sheet discharge section 40. The image forming section 10 includes an intermediate transfer body 11, developing sections 12~15, a plurality of primary transfer rollers 17 (17-1~17-4), a secondary transfer section 18 and an exposure section 19.

The intermediate transfer body 11 is a specific example of the image carrier. The intermediate transfer body 11 may be an endless belt, for example. The intermediate transfer body 11 is rotated in an arrow 101 direction by a roller. In the present embodiment, an upstream side and a downstream side are defined based on the direction in which the intermediate transfer body 11 moves. On the surface of the intermediate transfer body 11, the visible image generated in the developing sections 12~15 is transferred. The transfer of the visible image onto the intermediate transfer body 11 corresponds to a primary transfer step.

The developing sections 12~15 form the visible image by using toner of different properties. For example, in some developing sections, toner of different colors may be used. Toner of each color of yellow (Y), magenta (M), cyan (C) and black (K) may be used as the toner having different colors. For example, in some developing sections, a toner whose color is eliminated by an external stimulus (for example, heat) may be used. For example, in some developing sections, a special toner such as glossy toner or fluorescent toner may be used. In FIG. 3, the developing section 12 is positioned at the most upstream side among the four developing sections, and the developing section 15 is positioned at the most downstream side among the four developing sections.

The developing sections 12~15 have the same constitution although the properties of the used toner are different. The developing section is described below by taking the developing section 12 as an example. The developing section 12 includes a developing device 12*a*, a photoconductive drum 12*b*, a charging device 12*c* and a cleaning blade 12*d*.

The developing device 12*a* houses the developer. The developing device 12*a* attaches the developer to the photoconductive drum 12*b*. The photoconductive drum 12*b* has the photoconductor (photosensitive area) on an outer peripheral surface thereof. The photoconductor is, for example, an OPC (organic photoconductor). The photoconductive drum 12*b* receives exposure by the exposure section 19 to form the electrostatic latent image on the surface thereof.

The charging device 12*c* uniformly charges the surface of the photoconductive drum 12*b*.

The cleaning blade 12*d* is, for example, a plate-like member, and the cleaning blade 12*d* is made of rubber such as urethane resin, for example. The cleaning blade 12*d* removes the developer adhering to the photoconductive drum 12*b*.

Next, an outline of the operation of the developing section 12 is described. The photoconductive drum 12*b* is charged to a predetermined potential by the charging device 12*c*. The light is irradiated from the exposure section 19 to the photoconductive drum 12*b*. In this way, the potential of the area irradiated with the light on the photoconductive drum 12*b* changes. Due to this change, the electrostatic latent image is formed on the surface of the photoconductive drum 12*b*. The electrostatic latent image on the surface of the photoconductive drum 12*b* is developed by the developer of the developing device 12*a*. The visible image developed by the developer is formed on the surface of the photoconductive drum 12*b*.

The primary transfer roller 17 (17-1~17-4) transfers the visible image formed on the photoconductive drum by each of the developing sections 12~15 onto the intermediate transfer body 11.

The secondary transfer section 18 includes a secondary transfer roller 181 and a secondary transfer opposed roller 182. The secondary transfer section 18 collectively transfers the visible image formed on the intermediate transfer body 11 onto a sheet subjected to the image formation. The transfer by the secondary transfer section 18 is realized by a potential difference between the secondary transfer roller 181 and a secondary transfer opposed roller 182, for example.

The exposure section 19 forms the electrostatic latent image by irradiating the photoconductive drums of the developing sections 12~15 with the light. The exposure section 19 includes a light source such as a laser or a light emitting diode (LED).

The adhesion amount sensor 20 is arranged between the developing section 15 and the secondary transfer section 18 at the most downstream side so as to detect the adhesion amount of the developer on the intermediate transfer body 11.

The fixing section 30 fixes the visible image on the sheet by applying heat and pressure to the visible image transferred onto the sheet.

The sheet discharge section 40 discharges the sheet on which the visible image is fixed by the fixing section 30.

Figure 4:
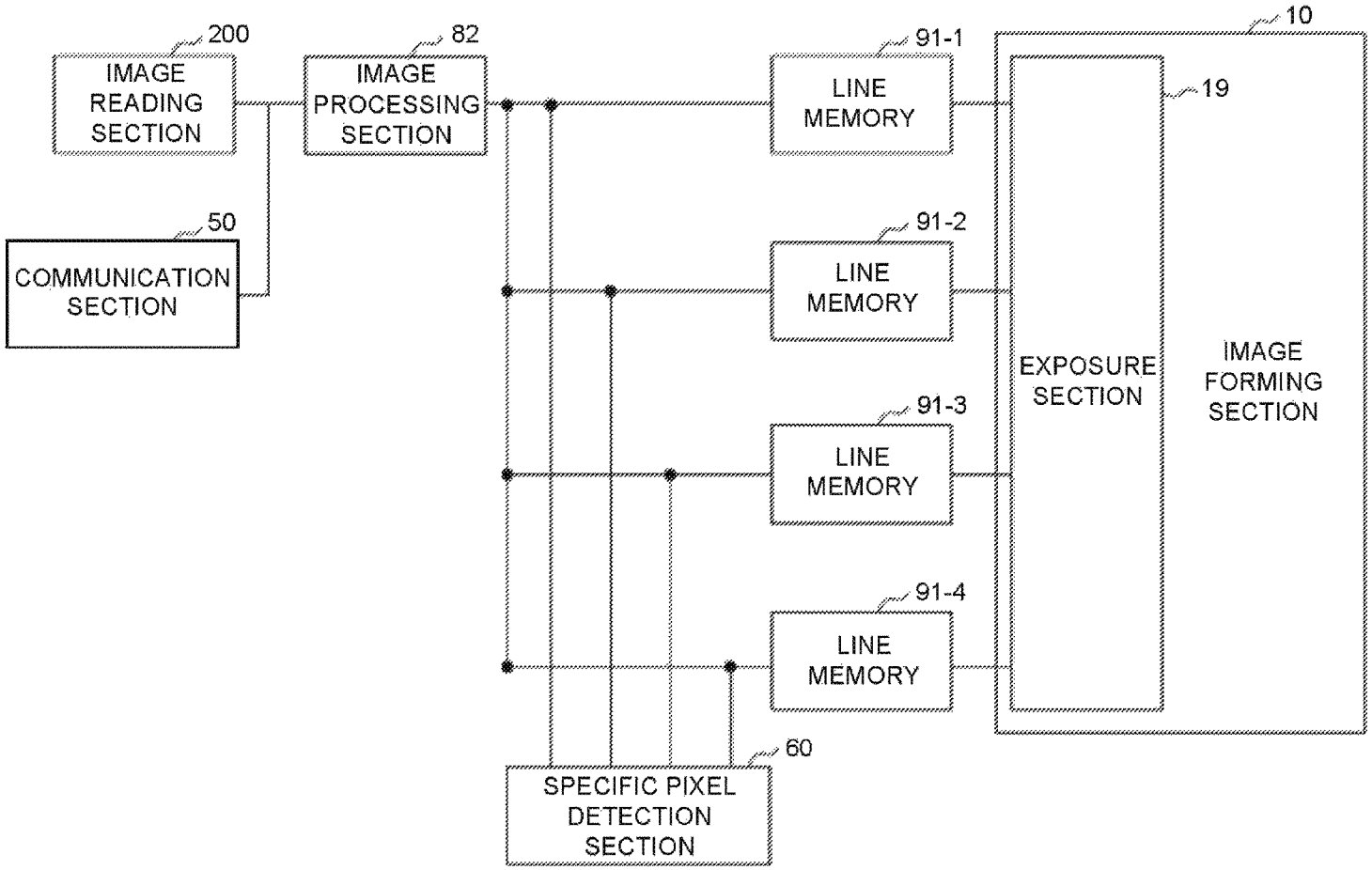
FIG. 4 is a diagram illustrating an implementation example of a specific pixel detection section 60.

FIG. 4 is a diagram illustrating an implementation example of the specific pixel detection section 60. The processing target image is input to the image processing section 82. The processing target image may be an image read by the image reading section 200 or an image received from another apparatus via the communication section 50. The image processing section 82 converts the image subjected to image processing to grayscale image data according to the type of each toner. The grayscale image data indicates the density of each toner for each pixel. The image processing section 82 outputs the grayscale image data corresponding to the type of each toner to each line memory 91 (for example, 91-1~91-4) corresponding to each type of toner.

The line memory 91 stores the grayscale image data output from the image processing section 82. The line memory 91 may be provided for each type of toner. For example, the line memory 91-1 may store a grayscale image formed of the cyan toner. The line memory 91-2 may store a grayscale image formed of the magenta toner. The line memory 91-3 may store a grayscale image formed of the yellow toner. The line memory 91-4 may store a grayscale image formed of the black toner. Each line memory 91 stores grayscale image data for each line. The line memory 91 outputs the grayscale image data of the same line to the exposure section 19 in synchronization with other line memories 91.

The exposure section 19 outputs the light having an intensity corresponding to the value (value indicating grayscale: value of pixel) of each pixel of the grayscale image data output from the line memory 91. The light output by the exposure section 19 is emitted to the photoconductive drum 12*b* of the developing section 12 corresponding to each grayscale image data.

The grayscale image data output from the image processing section 82 to each line memory 91 branches on a path and is acquired by the specific pixel detection section 60. The specific pixel detection section 60 determines that the pixel is the specific pixel if the values are given to the same pixel over a plurality of grayscale images among the grayscale images output to each line memory 91. The specific pixel detection section 60 may determine the specific pixel based on pixels given values other than 0. For example, in a case in which the pixel can take a value from 0 to 255, the specific pixel may be determined based on the pixels given values greater than or equal to 1. The specific pixel detection section 60 may determine the specific pixel based on the pixels given values greater than or equal to a predetermined threshold value. For example, if the pixel can take values from 0 to 255, the specific pixel may be determined based on the pixels given values greater than or equal to the predetermined threshold value (e.g., 50).

The specific pixel detection section 60 outputs information indicating the amount of the specific pixels. For example, the specific pixel detection section 60 may output the number of pixels for the specific pixel. For example, the specific pixel detection section 60 may output a value indicating a proportion occupied by the specific pixel among all the pixels output from the image processing section 82. The specific pixel detection section 60 may output information indicating the amount of the specific pixels for each combination of the types of the toner (for example, cyan, magenta, yellow and black) used in the same pixel. In this case, the determination section 84 may give a predetermined weight corresponding to the combination of the types of the toner to the information indicating the amount of the specific pixels in each combination. The determination section 84 may determine whether or not the second condition is satisfied based on the information obtained in this way. For example, a greater weight may be given to the combination of the types of the toner (for example, a combination of colors of toner) making the deviation more conspicuous for human eyes.

Figure 5:
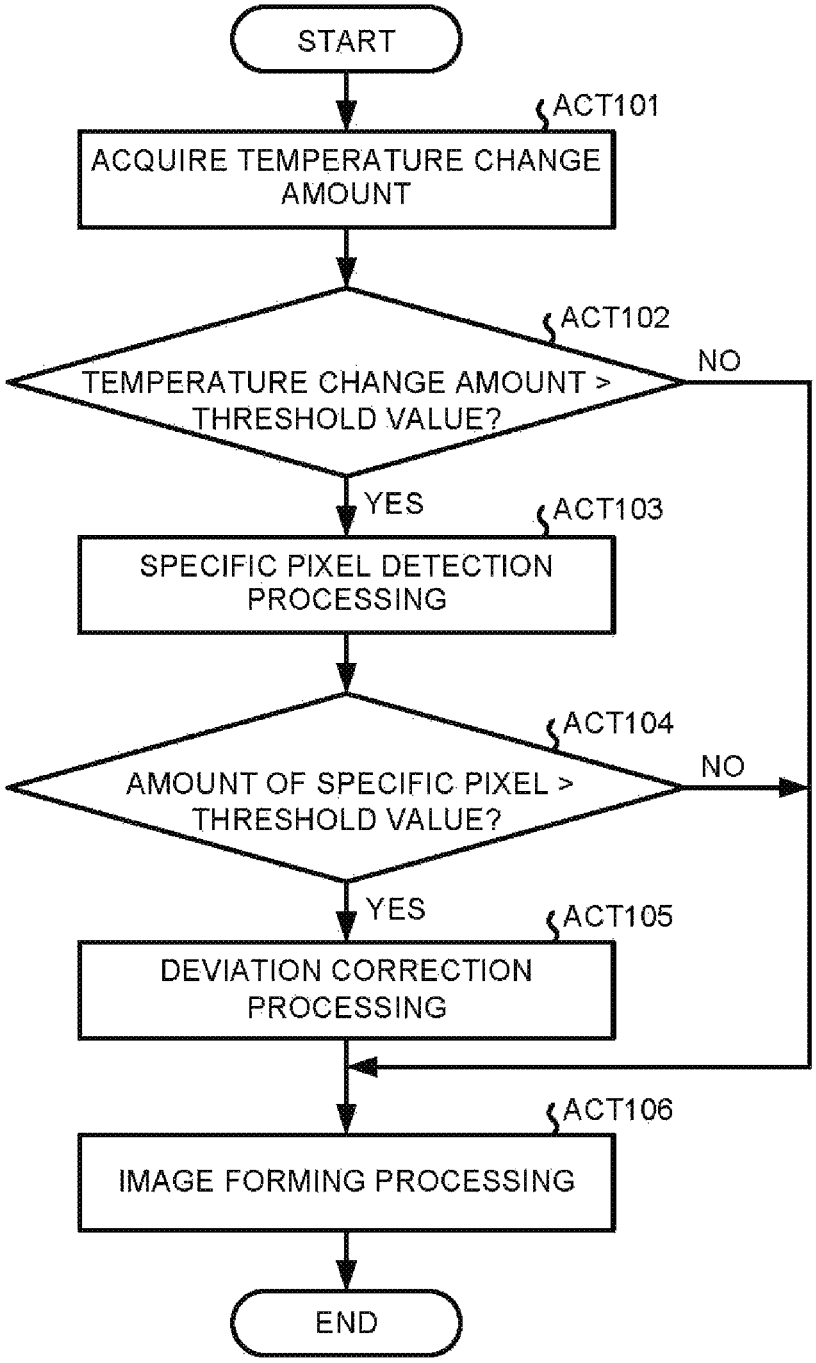
FIG. 5 is a flowchart illustrating a concrete example of a processing by a controller 80 at the time of forming a processing target image.

FIG. 5 is a flowchart illustrating a concrete example of a processing by the controller 80 at the time of forming the processing target image. If the image formation is executed, the determination section 84 acquires the temperature change amount (ACT 101). If the temperature change amount is less than the predetermined threshold value (NO in ACT 102), the determination section 84 determines that the deviation correction processing is not executed. In this case, the deviation correction section 83 does not execute the deviation correction processing, and the image forming controller 81 instructs the image forming section 10 to execute the image forming processing. In response to this instruction, the image forming section 10 executes the image forming processing on the processing target image (ACT 106).

On the other hand, if the temperature change amount is greater than or equal to the predetermined threshold value (YES in ACT 102), the specific pixel detection section 60 executes the specific pixel determination processing on the processing target image (ACT 103). Based on the detection result of the specific pixel detection section 60, the determination section 84 determines whether or not the amount of the specific pixels exceeds the predetermined threshold value (ACT 104). If the amount of the specific pixels does not exceed the predetermined threshold value (NO in ACT 104), the determination section 84 determines that the deviation correction processing is not executed. In this case, the deviation correction section 83 does not execute the deviation correction processing, and the image forming controller 81 instructs the image forming section 10 to execute the image forming processing. In response to this instruction, the image forming section 10 executes the image forming processing on the processing target image (ACT 106).

On the other hand, if the amount of the specific pixels exceeds the predetermined threshold value (YES in ACT 104), the determination section 84 determines the execution of the deviation correction processing. In this case, the deviation correction section 83 executes the deviation correction processing (ACT 105). Upon completion of the deviation correction processing, the image forming controller 81 instructs the image forming section 10 to execute the image forming processing. In response to this instruction, the image forming section 10 executes the image forming processing on the processing target image (ACT 106).

In the image forming apparatus 100 configured as described above, the deviation correction processing is not executed sometimes even if the first condition based on the measurement result of the temperature in apparatus is satisfied. In other words, the deviation correction processing is not executed unless the second condition based on the detection result of the specific pixel is satisfied. That the second condition is not satisfied means that there are few pixels (specific pixels) formed with a plurality of toner. If there are few specific pixels, even if the transfer position deviation occurs, the possibility that image quality degradation due to the transfer position deviation is not conspicuous is high. In such a case, since the image formation is executed without executing the deviation correction processing, the result of printing (image forming processing) can be obtained at an earlier timing. Therefore, it is possible to suppress both the image quality deterioration and the decrease in the speed of the image forming processing.

In FIG. 5, the processing in ACT 101 and ACT 102 and the processing in ACT 103 and ACT 104 may be executed in reverse order. In other words, the processing in ACT 103 and ACT 104 may be executed prior to the processing in ACT 101 and ACT 102. However, in general, the detection processing of the specific pixel (ACT 103) takes more time than the acquisition processing of the temperature change amount (ACT 101). Therefore, by executing the processing in the ACT 101 and the ACT 102 first, it is possible to suppress the speed reduction due to the execution of the detection processing of the specific pixel.

While certain embodiments have been described these embodiments have been presented by way of example only, and are not intended to limit the scope of the inventions. Indeed, the novel embodiments described herein may be embodied in a variety of other forms: furthermore various omissions, substitutions and changes in the form of the embodiments described herein may be made without departing from the spirit of the inventions. The accompanying claims and there equivalents are intended to cover such forms or modifications as would fall within the scope and spirit of the invention.

What is claimed is:

1. An image forming apparatus, comprising:

a developing section configured to form a visible image on a photoconductor for each type of developer;

an image carrier configured to carry visible images formed in a plurality of the developing sections;

a deviation correction section configured to correct position deviation of the plurality of visible images formed on the image carrier;

a specific pixel detection section configured to detect a specific pixel used to form an image with each type of developer; and a determination section configured to determine execution of correction in the deviation correction section according to information indicating an amount of the specific pixels.

2. The image forming apparatus according to claim 1, wherein the determination section determines whether or not a first condition correlating with occurrence of a transfer position deviation is satisfied and determines execution of correction in the deviation correction section based on the first condition and a second condition which is based on a detection result of the specific pixel.

3. The image forming apparatus according to claim 2, further comprising:

a temperature sensor in apparatus configured to detect a temperature within an inside of the image forming apparatus, wherein the determination section determines the execution of correction in the deviation correction section according to a condition based on the temperature within the image forming apparatus as the first condition.

4. The image forming apparatus according to claim 3, wherein the determination section determines, as the first condition, whether or not a temperature change amount indicating a difference between the temperature within the image forming apparatus which is a measurement result of the temperature sensor at the time of forming the processing target image and a temperature within the image forming apparatus at the time of executing the deviation correction processing last time is equal to or greater than a predetermined threshold value.

5. The image forming apparatus according to claim 2, wherein the determination section determines the first condition first and then determines the second condition only in a case in which there is a possibility of executing the correction in the deviation correction section according to the first condition.

6. The image forming apparatus according to claim 1, wherein a plurality of the developing sections forms the visible images with developers having different colors.

7. The image forming apparatus according to claim 1, wherein the determination section determines the execution of the correction in the deviation correction section based on a result obtained by giving weight in response to combination of types of the developers used in the same pixel to information indicating the amount of the specific pixels.

8. The image forming apparatus according to claim 7, wherein the determination section gives a greater weight as the combination of the developers makes the deviation more conspicuous for human eyes.

9. The image forming apparatus according to claim 8, wherein a plurality of the developing sections forms the visible images with developers having different colors, and the determination section gives weight in response to combination of the colors.

10. A control method, comprising:

forming a visible image on a photoconductor for each type of developer;

transferring visible images formed in a plurality of the developing sections onto an image carrier;

detecting a specific pixel used to form an image with a each type of developer; and determining execution of deviation correction processing for correcting position deviation of a plurality of visible images transferred onto the image carrier according to information indicating an amount of the specific pixels.

11. The control method according to claim 10, further comprising:

determining whether or not a first condition correlating with occurrence of a transfer position deviation is satisfied and determining execution of correction based on the first condition and a second condition which is based on a detection result of the specific pixel.

12. The control method according to claim 11, further comprising:

detecting a temperature within an inside of an image forming apparatus; and determining the execution of correction according to a condition based on the temperature within the image forming apparatus as the first condition.

13. The control method according to claim 11, further comprising:

determining the first condition first and then determining the second condition only in a case in which there is a possibility of executing the correction according to the first condition.

14. The control method according to claim 10, further comprising:

forming the visible images with developers having different colors.

15. The control method according to claim 10, further comprising:

determining the execution of the correction based on a result obtained by giving weight in response to combination of types of the developers used in the same pixel to information indicating the amount of the specific pixels.

16. A deviation correction apparatus, comprising:

a deviation correction section configured to correct position deviation of a plurality of visible images formed on an image carrier;

a specific pixel detection section configured to detect a specific pixel used to form an image with each type of developer; and a determination section configured to determine execution of correction in the deviation correction section according to information indicating an amount of the specific pixels.

17. The deviation correction apparatus according to claim 16, wherein the determination section determines whether or not a first condition correlating with occurrence of a transfer position deviation is satisfied and determines execution of correction in the deviation correction section based on the first condition and a second condition which is based on a detection result of the specific pixel.

18. The deviation correction apparatus according to claim 17, further comprising:

a temperature sensor configured to detect a temperature within an inside of an image forming apparatus, wherein the determination section determines the execution of correction in the deviation correction section according to a condition based on the temperature within the image forming apparatus as the first condition.

19. The deviation correction apparatus according to claim 18, wherein the determination section determines, as the first condition, whether or not a temperature change amount indicating a difference between the temperature within the image forming apparatus which is a measurement result of the temperature sensor at the time of forming the processing target image and a temperature within the image forming apparatus at the time of executing the deviation correction processing last time is equal to or greater than a predetermined threshold value.

20. The deviation correction apparatus according to claim 17, wherein the determination section determines the first condition first and then determines the second condition only in a case in which there is a possibility of executing the correction in the deviation correction section according to the first condition.

* * * * *